US010995582B2

(12) United States Patent
Petrie et al.

(10) Patent No.: US 10,995,582 B2
(45) Date of Patent: May 4, 2021

(54) FLUID PLACEMENT TOOL

(71) Applicant: Halliburton Energy Services, Inc., Houston, TX (US)

(72) Inventors: Robert Alexander Petrie, Gunnison, CO (US); Michael John Houston, Bell Fourche, SD (US); David Eugene Colburn, Jr., Mead, CO (US)

(73) Assignee: Halliburton Energy Services, Inc., Houston, TX (US)

( * ) Notice: Subject to any disclaimer, the term of this patent is extended or adjusted under 35 U.S.C. 154(b) by 152 days.

(21) Appl. No.: 16/159,183

(22) Filed: Oct. 12, 2018

(65) Prior Publication Data

US 2019/0128094 A1 May 2, 2019

Related U.S. Application Data

(60) Provisional application No. 62/578,112, filed on Oct. 27, 2017.

(51) Int. Cl.

| | |
|---|---|
| ***E21B 17/18*** | (2006.01) |
| ***E21B 33/138*** | (2006.01) |
| ***E21B 21/00*** | (2006.01) |
| ***E21B 25/00*** | (2006.01) |
| ***E21B 33/136*** | (2006.01) |

(52) U.S. Cl.

CPC ..... *E21B 33/138* (2013.01); *E21B 17/18* (2013.01); *E21B 21/003* (2013.01); *E21B 25/00* (2013.01); *E21B 33/136* (2013.01)

(58) Field of Classification Search

CPC ..... E21B 33/138; E21B 21/003

USPC ..... 175/207

See application file for complete search history.

(56) References Cited

U.S. PATENT DOCUMENTS

| | | | | |
|---|---|---|---|---|
| 2015/0226029 | A1 | 8/2015 | Oliver et al. | |
| 2018/0328142 | A1* | 11/2018 | Robert | E21B 34/08 |
| 2019/0178051 | A1* | 6/2019 | Beach | C09K 8/04 |

OTHER PUBLICATIONS

"AMC BOS, A proactive solution for fluid loss and borehole instability," product brochure, dated Oct. 2017.

* cited by examiner

*Primary Examiner* — Taras P Bemko
(74) *Attorney, Agent, or Firm* — Tenley Krueger; C. Tumey Law Group PLLC

(57) ABSTRACT

Systems, methods, and apparatuses of the present disclosure generally relate to fluid placement tools. A fluid placement tool includes a connecting section at a proximal end of the fluid placement tool for coupling the fluid placement tool to a conveyance. The fluid placement tool also includes an actuating section coupled to the connecting section, wherein the actuating section comprises a first check valve and a piston, wherein the first check valve is positioned to allow fluid flow through the actuating section and into engagement with the piston. The fluid placement tool also includes a fluid containment section, wherein the fluid containment section comprises a fluid reservoir and a second check valve, wherein the fluid reservoir is disposed between the first check valve and the second check valve, wherein the second check valve is position to only allow flow out of the fluid containment section. The actuating section is operable to drive the piston through the fluid reservoir for displacement of a fluid from the fluid reservoir and into a wellbore.

17 Claims, 3 Drawing Sheets

FLUID PLACEMENT TOOL

BACKGROUND

Exploration diamond drilling may be used in the mining industry to probe the contents of known ore deposits and potential sites. Operators may extract a core of rock to be analyzed (structurally and chemically) by geologists. Core drilling may typically be conducted with a core bit connected to a rotary drill. As the core bit advances, a core sample of rock may be produced. The functionality of the core bit may dependent on the rock type. Depending on the rock type and size of hole the core may rotate between 800 to 4,000 rotations per minutes, for example. As such, fluid lubrication may be required to maintain bit life, stabilize formation and remove cutting from the hole. The type of the drilling fluid used for fluid lubrication may be dependent on the geology being drilled. In highly porous or fractured rock, the drilling fluid may be lost to the formation. Fluid loss may result in reduced lubrication, cuttings transport and rate of penetration (ROP). To address this and other issues, stabilizing agents, such as cement slurries and or Lost Circulation Materials (LCM), may be placed into the formation to seal the zones of the formation to stabilize and/or prevent loss of the drilling fluid from the borehole.

BRIEF DESCRIPTION OF THE DRAWINGS

These drawings illustrate certain aspects of some of the examples of the present invention and should not be used to limit or define the invention.

DETAILED DESCRIPTION

The present disclosure relates generally to a fluid placement tool for usage in wellbore applications, such as mineral exploration. More particularly, examples may relate to a fluid placement tool that may place a discrete quantity of a fluid at a specified depth. For example, the fluid placement tool may place the fluid below a drill bit in a coring application. In examples, the fluid placement tool may be constructed with multiple parts and connections and may be employed downhole in a wellbore to obtain core samples. While the description herein is with respect to mineral exploration, it should be understood that the fluid placement tool may be used in any suitable application for placement of a fluid in a wellbore.

Figure 1:
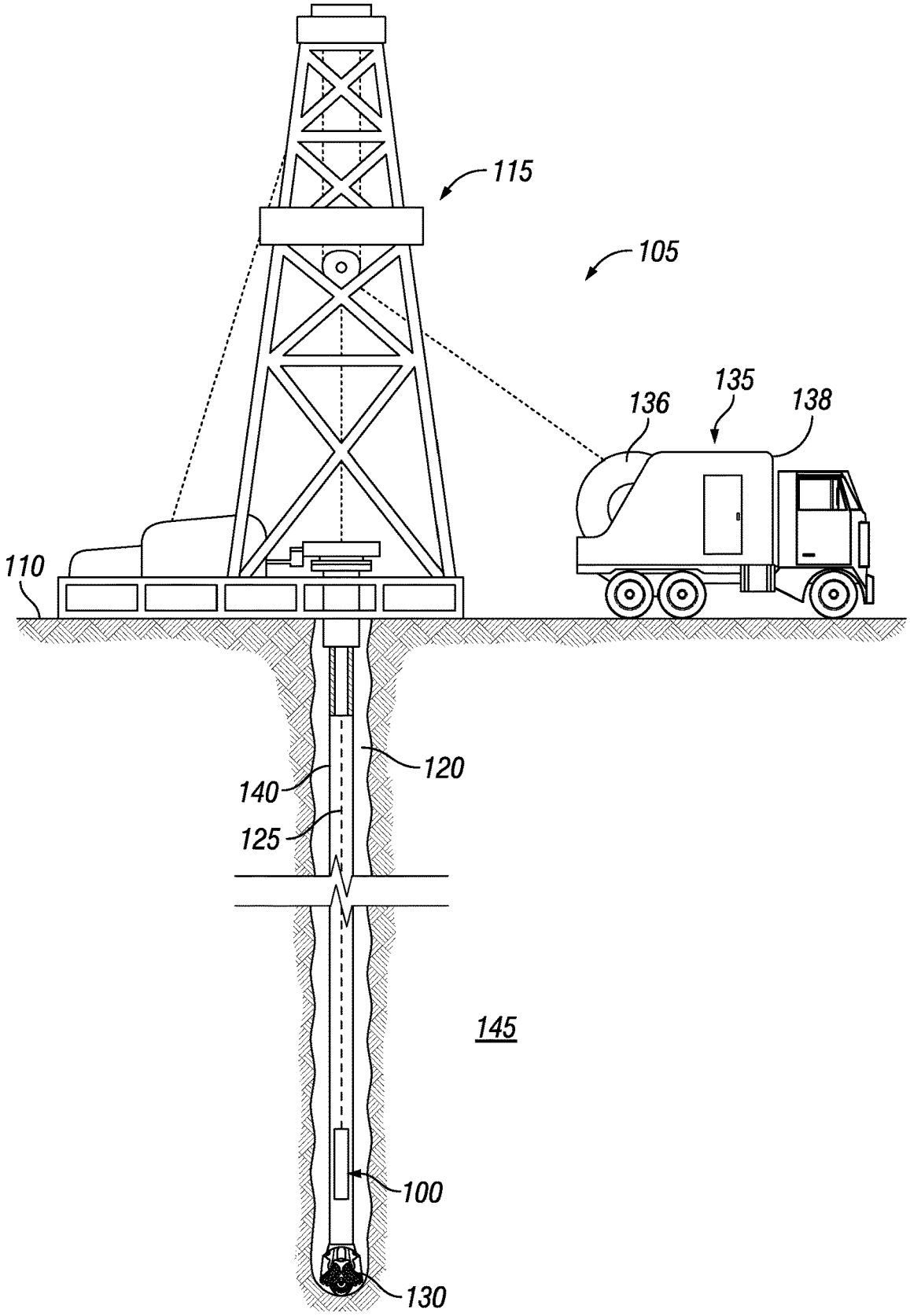
FIG. 1 illustrates an example of a fluid placement tool in a wireline system.

FIG. 1 depicts a fluid placement tool 100 disposed in a well system 105. Fluid placement tool 100 may place a discrete quantity of a suitable fluid at a specified depth. Without limitations, the suitable fluid may be a cement slurry, resin, fluids with lost circulation materials (LCM), and/or combinations thereof. As illustrated, various types of equipment may be located at a well surface 110. For example, well surface 110 may include a rig 115 that may use a conveyance 125, such as ropes, wires, lines, tubular strings, and/or cables to suspend fluid placement tool 100 in wellbore 120. Additional examples of a suitable conveyance 125 may include, but are not limited to, a wireline, slickline, sand line, rig wire, drill pipe, work string, and/or other suitable conveyance. Although FIG. 1 illustrates land-based equipment, fluid placement tool 100 incorporating the teachings of the present disclosure may be satisfactorily used with equipment located on offshore platforms, drill ships, semi-submersibles, and drilling barges. Additionally, while wellbore 120 is shown as being a generally vertical wellbore, wellbore 120 may be any orientation including generally horizontal, multilateral, or directional.

Conveyance 125 may mechanically and/or electrically suspend fluid placement tool 100 within wellbore 120 as fluid placement tool 100 is being disposed downhole. As described above, conveyance 125 may be any suitable type of conveyance, such as a rope, cable, line, tube, or wire which may be suspended in wellbore 120. Conveyance 125 may be a single strand (e.g., a slickline) and/or a compound or composite line made of multiple strands woven or braided together (e.g., a wireline or coiled tubing). In examples wherein conveyance 125 may be a compound line, a stronger line may be used to support fluid placement tool 100 when multiple strands are required to carry different types of power, signals, and/or data to fluid placement tool 100. As one example of a compound line, conveyance 125 may include multiple fiber optic cables braided together and the cables may be coated with a protective coating. Conveyance 125 may be coupled to wireline unit 135. As illustrated, wireline unit 135 may include a drum 136 for conveying conveyance 125 into wellbore 120. In some embodiments, wireline unit 135 may further include a vehicle 138 that supports drum 136. While drum 136 is shown on FIG. 1 supported by vehicle 138 in the form of a truck, it should be understood that other suitable structures may be used for supporting drum 136 at well surface 110.

Fluid placement tool may be disposed in a tubular, such as core barrel 140. Core barrel 140 may be disposed in wellbore 120 as shown in FIG. 1. A coring bit 130 may be disposed on core barrel 140 and used to obtain core samples from wellbore 120. The coring bit 130 may be rotated from well surface 110 to drill into a formation 145 surrounding wellbore 120 for recovering core samples. The coring bit 130 may have a central opening and may include one or more blades (or cutting surfaces) disposed outwardly from exterior portions of a body of the coring bit 130. The body may be generally curved and the one or more blades may be any suitable type of projections extending outwardly from the body. The blades may include one or more cutting elements disposed outwardly from exterior portions of each blade. The coring bit 130 may have many different designs, configurations, and/or dimensions according to the particular application of the coring bit. As the coring bit 130 rotates and cuts into the formation 145, the coring bit 130 may form a generally cylindrical core sample by cutting the formation 145 around the central opening of the coring bit 130 while leaving the portion of the formation 145 in the central opening intact in order to obtain the core sample. After the coring bit 130 obtains the core sample, the core sample may be stored in core barrel 140. For example, the fluids in and surrounding the core sample and the initial reservoir pressure and temperature conditions may be maintained for analysis after the core sample is removed from core barrel 140 at well surface 110.

Typically in drilling and/or cutting operations, a fluid may be applied on and around the area of operation for lubrication of the coring bit 130 and removal of cutting to well surface 110. However, fluid may be undesirably lost in the formation 145, for example, when certain subterranean zones may be encountered. Accordingly, fluid placement tool 100 may be used to introduce a fluid into wellbore 120 for stabilizing formation 145 and/or sealing such formation.

Concerning the present disclosure, fluid placement tool 100 may be disposed in core barrel 140 and used to introduce a fluid through core bit 130.

Figure 2:
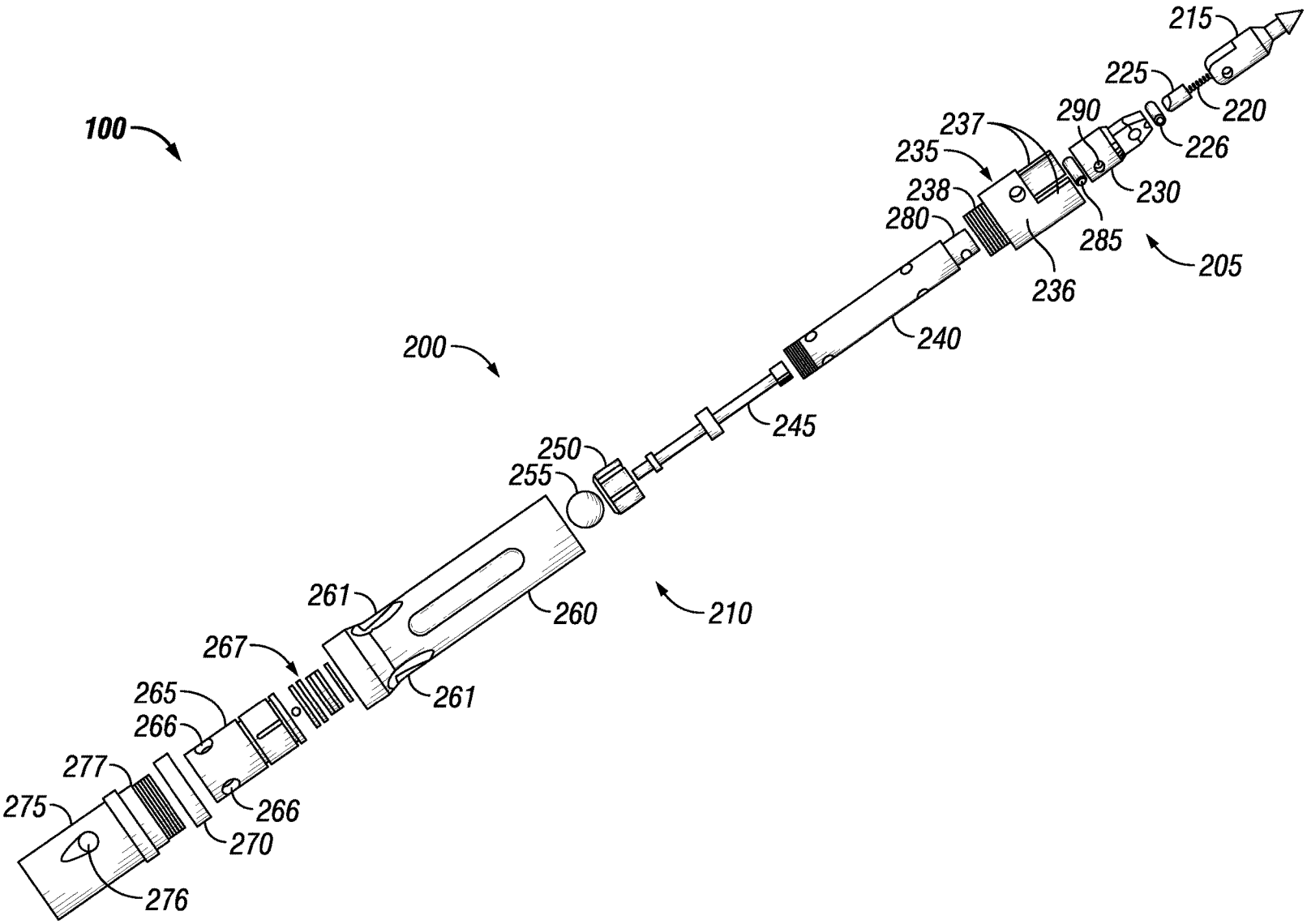
FIG. 2 illustrates a first portion of a fluid placement tool.

FIG. 2 illustrates a first portion 200 of a fluid placement tool 100. First portion 200 may be any suitable designation of a portion of fluid placement tool 100. In examples, first portion 200 of fluid placement tool 100 may comprise of a connecting section 205 and an actuating section 210. Connecting section 205 may connect to any suitable equipment outside of wellbore 120 (e.g., referring to FIG. 1). For example, connecting section 205 may couple fluid placement tool 100 to conveyance 125 (e.g., referring to FIG. 1) for delivery of fluid placement tool 100 into wellbore 120. Connecting section 205 may be coupled to an end of actuating section 210 through the use of any suitable mechanisms, including, but not limited to, the use of suitable fasteners, threading, adhesives, welding, and/or combinations thereof. Without limitation, suitable fasteners may include nuts and bolts, bushings, O-rings, washers, screws, pins, sockets, rods and studs, hinges and/or any combination thereof. The fluid placement tool 100 may be sized for placement in a tubular, such as core barrel 140. Without limitations, any suitable industry standard tubular such as PQ, HQ, and/or NQ sized tubulars may be used. For example, fluid placement tool 100 may have a length ranging from about 0.3 meters to about 2 meters and a diameter ranging from about 7 centimeters to about 50 cm. However, it should be understood that dimensions outside these ranges may be suitable depending for example, on a particular application.

As illustrated, connecting section 205 may comprise of a spearhead 215, a first spring 220, a plunger 225, and a base 230. Spearhead 215 may serve as the attachment point within connecting section 205. In examples, spearhead 215 may be a spearhead point. While spearhead 215 is shown, connection section 205 may use any suitable connecting mechanism that provides a surface to latch onto from external equipment. Spearhead 215 may be replaced with any suitable connectors that allow material to pass through. Spearhead 215 may be any suitable size, height, or shape. Without limitation, spearhead 215 may comprise any suitable material such as metals, nonmetals, polymers, ceramics, and/or any combination thereof. Spearhead 215 may be disposed at an end of first spring 220, wherein first spring 220 may be disposed at least partially in an interior bore in spearhead 215.

First spring 220 may serve to supply a resistance to a compressive force. In examples, as fluid placement tool 100 lands on a collar (not shown), an operator may continue to dispose conveyance 125 (e.g., referring to FIG. 1) downhole. In examples, an operator may be defined as an individual, group of individuals, or an organization. Visual recognition of slack within conveyance 125 may inform the operator that fluid placement tool 100 is in place. First spring 220 may experience the weight of spearhead 215. The resistance to the compressive force of the weight of the spearhead 215 may inhibit the movement of spearhead 215 further down closer to other components of fluid placement tool 100. First spring 220 may be any suitable size, height, or shape. Without limitation, first spring 220 may comprise any suitable material such as metal, plastic, an alloy, or any combination thereof. In examples, an opposing end of first spring 220 may be engage plunger 225.

Plunger 225 may be disposed at an opposite end of first spring 220 from spearhead 215. Plunger 225 may serve to depress into base 230. Without limitation, plunger 225 may comprise any suitable material such as metals, nonmetals, polymers, ceramics, and/or any combination thereof. Plunger 225 may be any suitable size, height, or shape. In examples, plunger 225 may have an end that has a shape that mirrors that of an opening in base 230. Base 230 may be any suitable size, height, or shape. Without limitation, base 230 may comprise any suitable material such as metals, nonmetals, polymers, ceramics, and/or any combination thereof. Base 230 may couple to a component within actuating section 210 through any suitable fastener. Without limitation, suitable fasteners may include nuts and bolts, washers, screws, pins, sockets, rods and studs, hinges and/or any combination thereof. Base 230 may serve to attach the components of connecting section 205 to actuating section 210. Base 230 may also be coupled to spearhead 215. As illustrated, pin 226 may be used to couple base 230 to spearhead 215. However, other suitable fasteners may also be used.

Actuating section 210 may serve to trigger the flow of a fluid out of fluid placement tool 100. Fluid placement tool 100 may contain any suitable liquid. As previously mentioned, a suitable fluid may be any cements, resins, fluids with lost circulation materials (LCM), and/or combinations thereof. As illustrated, actuating section 210 may comprise of a upper housing 235, an inner tubular 240, a ball shaft 245, a retaining cap 250, a first ball 255, a first housing tubular 260, a sleeve 265, a landing shoulder 270, and a second housing tubular 275.

Upper housing 235 may serve to receive base 230. Base 230 may be partially or completely disposed within upper housing 235. As illustrated, upper housing may a tubular body 236 having one or more wings 237 extending from one end toward proximal end of fluid placement tool 100. Opposite the one or more wings 237, the tubular body 236 may include a threaded end 238. Upper housing 235 may be any suitable size, height, or shape. In examples, upper housing 235 may have a cross-sectional shape of a circle and may have a bore that extends longitudinally there through. In some examples, the bore may be a cylindrical bore. Without limitation, upper housing 235 may comprise any suitable material such as metals, nonmetals, polymers, ceramics, and/or any combination thereof. Upper housing 235 may be disposed at an end of first housing tubular 260. Upper housing 235 may be disposed at an end of first housing tubular 260 through the use of any suitable mechanisms, including, but not limited to, the use of suitable fasteners, threading, adhesives, welding, and/or combinations thereof.

In examples, inner tubular 240 may be disposed inside of upper housing 235 and first housing tubular 260. Inner tubular 240 may have a length that runs partially or completely through upper housing 235 and/or first housing tubular 260. Inner tubular 240 may be any suitable size, height, or shape. In examples, inner tubular 240 may have a bore that extends longitudinally there through and may allow material to pass through it. In some examples, the bore of inner tubular 240 may be a cylindrical bore. Inner tubular 240 may have a cross-sectional shape of a circle. Without limitation, inner tubular 240 may comprise any suitable material such as metals, nonmetals, polymers, ceramics, and/or any combination thereof. Inner tubular 240 may comprise of a tubular hole 280 in outer wall thereof. There may be a plurality of tubular holes 280. Tubular hole 280 may be an absence of material. In examples, tubular hole 280 may be any suitable size or shape. In examples, tubular hole 280 may serve to connect inner tubular 240 to another component of fluid placement tool 100. Tubular hole 280 may be disposed about any location along inner tubular 240.

In examples, at least one tubular hole 280 may be disposed at an end of inner tubular 240 to connect inner tubular 240 to base 230. In examples, as the end of inner tubular 240 with tubular hole 280 is disposed about base 230, a pin 285 may be disposed through tubular hole 280 and through a corresponding base hole 290 in order to couple inner tubular 240 to base 230. Both ends of inner tubular 240 may be disposed about other components of fluid placement tool 100 through the use of any suitable mechanisms, including, but not limited to, the use of suitable fasteners, threading, adhesives, welding, and/or combinations thereof. As inner tubular 240 may have a cylindrical bore, inner tubular 240 may be disposed around ball shaft 245.

Ball shaft 245 may serve to actuate first ball 255. Ball shaft 245 may be any suitable size, height, or shape. Without limitation, ball shaft 245 may comprise any suitable material such as metals, nonmetals, polymers, ceramics, and/or any combination thereof. In examples, ball shaft 245 may be disposed within inner tubular 240. Ball shaft 245 may have a length that runs partially or completely through inner tubular 240. An end of ball shaft 245 may abut an internal recess (not illustrated) of inner tubular 240. An opposing end of ball shaft 245 may be threaded. In examples, the threaded end of ball shaft 245 may be disposed within first ball 255, wherein first ball 255 may abut retaining cap 250. In other words, first ball 255 may be threaded onto ball shaft 245.

Retaining cap 250 may serve to support first ball 255. Retaining cap 250 may be any suitable size, height, or shape. Retaining cap 250 may have a cross-sectional shape of a circle. Retaining cap 250 may have an internal and external diameter of any suitable dimension. Without limitation, retaining cap 250 may comprise any suitable material such as metals, nonmetals, polymers, ceramics, and/or any combination thereof. In examples, retaining cap 250 may allow material to pass through it. For example, retaining cap 250 may have a bore that extends longitudinally there through. In examples, the internal diameter of one end of retaining cap 250 may be threaded. In examples, the threaded end of retaining cap 250 may be disposed around an end of inner tubular 240, wherein the end of inner tubular 240 may be threaded. An opposing end of retaining cap 250 may be machined to match the shape of first ball 255. First ball 255 may abut an end of retaining cap 250. In examples, an end of retaining cap 250 may be chamfered to mirror the shape of first ball 255.

First ball 255 may be displaced along the axial length of fluid placement tool 100. First ball 255 may be any suitable size, height, or shape. In examples, first ball 255 may be a sphere. Without limitation, first ball 255 may comprise any suitable material such as metals, nonmetals, polymers, ceramics, and/or any combination thereof. In examples, first ball 255 may comprise a hole (not illustrated) that runs partially through it, and the hole may be threaded. An end of ball shaft 245 may be disposed within the hole of first ball 255. First ball 255 may be affixed to ball shaft 245, for example, first ball 255 may be threaded onto ball shaft 245. In examples, prior to operation of fluid placement tool 100, first ball 255 may abut retaining cap 250, wherein ball shaft 245 is disposed within retaining cap 250. In examples, ball shaft 245 may be actuated to move, thereby displacing first ball 255 axially along fluid placement tool 100 away from retaining cap 250. Ball shaft 245 may return to a previous location, thereby displacing first ball 255 back towards retaining cap 250. First ball 255 may subsequently be displaced through first housing tubular 260.

First housing tubular 260 may protect internal components of fluid placement tool 100 from an external environment. First housing tubular 260 may be any suitable size, height, or shape. In examples, first housing tubular 260 may have a bore that extends longitudinally there through and may allow material to pass through it. In some examples, the bore may be a cylindrical bore. First housing tubular 260 may have a cross-sectional shape of a circle. Without limitation, first housing tubular 260 may comprise any suitable material such as metals, nonmetals, polymers, ceramics, and/or any combination thereof. An end of first housing tubular 260 may be disposed at an end of upper housing 235. An opposing end of first housing tubular 260 may be disposed at an end of second housing tubular 275. Both ends of first housing tubular 260 may be disposed about other components of fluid placement tool 100 through the use of any suitable mechanisms, including, but not limited to, the use of suitable fasteners, threading, adhesives, welding, and/or combinations thereof. For example, an end of first housing tubular 260 may be secured to threaded end 238 of upper housing 235. In some embodiments, the end of first housing tubular 260 may include threads (not shown) for securing first housing tubular 260 to upper housing 235

In examples, sleeve 265 may be disposed within first housing tubular 260. Sleeve 265 may displace within first housing tubular 260 and/or second housing tubular 275. Sleeve 265 may comprise a bushing that may act as a seat for first ball 255. Sleeve 265 may be any suitable size, height, or shape. In examples, sleeve 265 may have a bore that extends longitudinally there through and may allow material to pass through it. In some examples, the bore may be a cylindrical bore. Without limitation, sleeve 265 may comprise any suitable material such as metals, nonmetals, polymers, ceramics, and/or any combination thereof. Sleeve 265 may comprise of a hole 266. There may be a plurality of holes 266. The hole 266 may be an absence of material. In examples, the hole may be any suitable size or shape. In examples, the hole 266 may serve allow a liquid to enter and/or exit fluid placement tool 100. The hole 2665 may be disposed about any location along sleeve 265. In examples, the holes 266 disposed on sleeve 265 may align with corresponding holes 261 disposed on first housing tubular 260. The presence of the holes 266 in sleeve 265 and holes 261 in first housing tubular 260 may provide a means of pressurizing fluid placement tool 100 in order for operation. In further examples, there may be grooves on sleeve 265 for any suitable gaskets 267 (e.g. O-rings). An end of sleeve 265 may abut landing shoulder 270, for example, to retain sleeve 265 in first housing tubular 260.

Landing shoulder 270 may serve to seal a portion of fluid placement tool 100 within wellbore 120 (e.g., referring to FIG. 1). Landing shoulder 270 may be any suitable size, height, or shape. In examples, landing shoulder 270 may have a cross-sectional shape of a circle. Without limitation, landing shoulder 270 may comprise any suitable material such as metals, nonmetals, polymers, ceramics, and/or any combination thereof. In examples, landing shoulder 270 may serve to seal the annulus formed between a tubular (e.g., a drill string, core barrel) in which the fluid placement tool 100 may be disposed within. In examples, as fluid placement tool 100 is lowered into wellbore 120, landing shoulder 270 may rest upon a landing ring of the tubular in the wellbore 120. In further examples, the landing ring may be located on second housing tubular 275.

Second housing tubular 275 may protect internal components of fluid placement tool 100 from an external environment. Second housing tubular 275 may be any suitable size, height, or shape. In examples, second housing tubular 275 may have a bore that extends longitudinally there through and may allow material to pass through it. In some examples, the bore may be a cylindrical bore. Second housing tubular 275 may have a cross-sectional shape of a circle. Without limitation, second housing tubular 275 may comprise any suitable material such as metals, nonmetals, polymers, ceramics, and/or any combination thereof. Second housing tubular 275 may comprise of a hole 276. There may be a plurality of holes 276. The hole 276 may be an absence of material. In examples, the hole 276 may be any suitable size or shape. The presence of the hole 276 in second housing tubular 275 may provide a means of pressurizing fluid placement tool 100 in order for operation (described further below). An end of second housing tubular 275 may be disposed at an end of first housing tubular 260. In examples, the end of second housing tubular 275 disposed at the end of first housing tubular 260 may be secured through the use of any suitable mechanisms, including, but not limited to, the use of suitable fasteners, threading, adhesives, welding, and/or combinations thereof. In examples, both corresponding ends may be threaded and able to mate together. For example, the end of second housing tubular 275 may include threads 277 for securing the second housing tubular 275 to first housing tubular 260. An opposing end of second housing tubular 275 may be disposed at an end of a first check valve (discussed further below), which may be disposed further within fluid placement tool 100.

Figure 3:
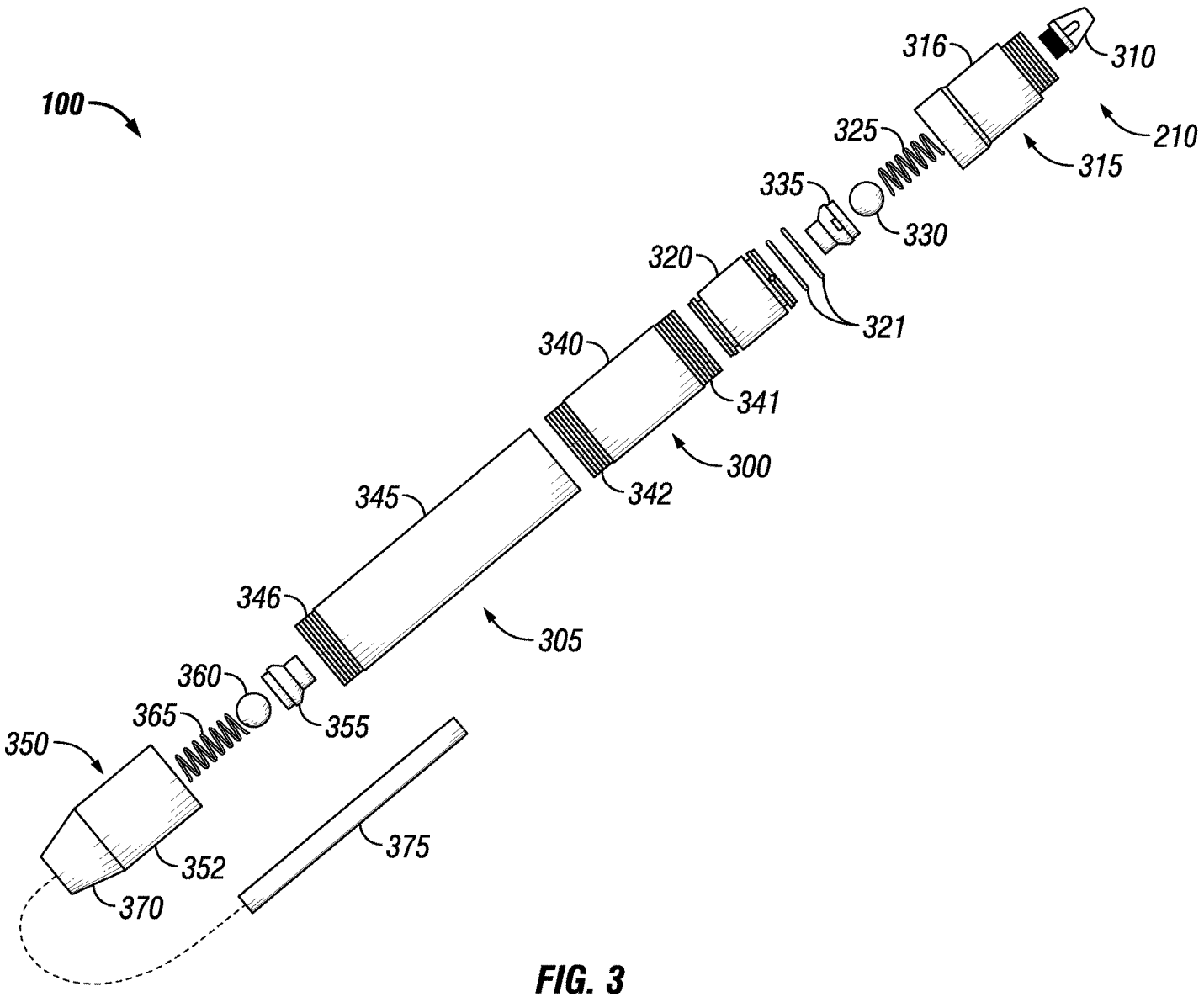
FIG. 3 illustrates a second portion of a fluid placement tool.

FIG. 3 illustrates a second portion 300 of fluid placement tool 100. In examples, first portion 200 (e.g., referring to FIG. 2) and second portion 300 may be coupled together to form the fluid placement tool 100. As illustrated, second portion 300 may comprise a portion of actuating section 210 and a fluid containment section 305. Fluid containment section 305 may be coupled to an end of actuating section 210 that is opposite of connecting section 205 (e.g., referring to FIG. 2). In examples, fluid containment section 305 and connecting section 205 may be disposed on opposite ends of actuating section 210. There may be a variety of different configurations of locations where connecting section 205, actuating section 210, and fluid containment section 305 may be located within fluid placement tool 100. The portion of actuating section within second portion 300 may comprise a ball stop 310, a first check valve 315, and a piston 320.

Ball stop 310 may serve to stop the motion of first ball 255 (e.g., referring to FIG. 2). Ball stop 310 may be any suitable size, height, or shape. Without limitation, ball stop 310 may comprise any suitable material such as metals, nonmetals, polymers, ceramics, and/or any combination thereof. In examples, an end of ball stop 310 may mirror the shape of first ball 255. In examples, ball stop 310 may be disposed within second housing tubular 275 (e.g., referring to FIG. 2). In examples, as first ball 255 moves axially through fluid placement tool 100, first ball 255 may allow and/or inhibit the flow of fluid into first check valve 315. First check valve 315 may allow the flow of liquid in one direction. First check valve 315 may comprise valve housing 316, second spring 325, a second ball 330, and a first check valve body 335. Valve housing 316 may be secured to second housing tubular 275, for example, by threads 317 on an end of valve housing 316. However, other suitable fasteners may also be sued. Second spring 325, second ball 330, and first check valve body 335 may be disposed in valve housing 316.

Second spring 325 may serve to hold second ball 330 in place and to compress and/or expand depending on which direction the fluid pressure is being applied to second ball 330. Second spring 325 may be any suitable size, height, or shape. Without limitation, second spring 325 may comprise any suitable material such as metals, nonmetals, polymers, ceramics, and/or any combination thereof. An end of second spring 325 may be disposed about an internal recess (not illustrated) within valve housing 316. An opposing end of second spring 325 may be disposed about second ball 330.

Second ball 330 may be disposed within valve housing 316 and may be received by first check valve body 335. Second ball 330 may be any suitable size, height, or shape. In examples, second ball 330 may be a sphere. Without limitation, second ball 330 may comprise any suitable material such as metals, nonmetals, polymers, ceramics, and/or any combination thereof. In examples second ball 330 may have similar dimensions and function the same way as first ball 255. Alternatively, second ball 330 may have varying dimensions and may function differently from first ball 255. In examples, second ball 330 may remain at rest within the designated flow path (not illustrated) of valve housing 316. In certain examples, fluid pressure may be applied to second ball 330 to displace second ball 330 out of the designated flow path so a fluid may travel through first check valve 315.

In examples, first check valve body 335 may serve to receive second ball 330. In operations, as fluid pressure exerts a force onto second ball 330, that force may be transferred to first check valve body 335. First check valve body 335 may be any suitable size, height, or shape. Without limitation, first check valve body 335 may comprise any suitable material such as metals, nonmetals, polymers, ceramics, and/or any combination thereof. In examples, an end of first check valve body 335 may mirror the shape of second ball 330. As first check valve body 335 receives second ball 330, fluid may be able to flow through first check valve 315 and further down into other components of fluid placement tool, such as piston 320.

Piston 320 may be at least partially disposed within valve housing 316 of first check valve 315. Piston 320 may be any suitable size, height, or shape. Without limitation, piston 320 may comprise any suitable material such as metals, nonmetals, polymers, ceramics, and/or any combination thereof. In examples, any suitable gasket 321 may be disposed about piston 320 so as to seal piston 320 to another component of fluid placement tool 100. In examples, as fluid pressure exerts a force onto an end of piston 320, piston 320 may be displaced into fluid containment section 305 of fluid placement tool 100. Fluid containment section 305 may serve to hold and dispense a fluid out of fluid placement tool 100. Fluid containment section 305 may comprise a fluid reservoir 340, a third housing tubular 345, and a second check valve 350.

Fluid reservoir 340 may contain a specified amount of a fluid. In examples, the fluid may be any cements, resins, fluids comprising LCMs, and/or combinations thereof. Fluid reservoir 340 may be any suitable size, height, or shape. In examples, fluid reservoir 340 may have a bore that extends longitudinally there through and may allow material to pass through it. In some examples, the bore may be a cylindrical bore. Without limitation, fluid reservoir 340 may comprise any suitable material such as metals, nonmetals, polymers, ceramics, and/or any combination thereof. An end of fluid reservoir 340 may be disposed at an end of first check valve 315. An opposing end of fluid reservoir 340 may be disposed at an end of third housing tubular 345. Both ends of fluid reservoir 340 may be secured through the use of any suitable mechanisms, including, but not limited to, the use of suitable fasteners, threading, adhesives, welding, and/or combinations thereof. For example, an end of fluid reservoir 340 may include first threads 341 for securing fluid reservoir 340 to valve housing 316. On opposite end of fluid reservoir 340 may include second threads 342 for securing fluid reservoir 340 to third housing tubular 345. In examples, as fluid pressure exerts a force onto an end of piston 320, piston 320 may be displaced into fluid reservoir 340, wherein the fluid within fluid reservoir 340 may be displaced into third housing tubular 345.

Third housing tubular 345 may protect internal components of fluid placement tool 100 from an external environment. Third housing tubular 345 may be any suitable size, height, or shape. In examples, third housing tubular 345 may have a bore that extends longitudinally there through and may allow material to pass through it. In some examples, the bore may be a cylindrical bore. Third housing tubular 345 may have a cross-sectional shape of a circle. Without limitation, third housing tubular 345 may comprise any suitable material such as metals, nonmetals, polymers, ceramics, and/or any combination thereof. An end of third housing tubular 345 may be disposed at an end of fluid reservoir 340. An opposing end of third housing tubular 345 may be disposed at an end of second check valve 350. Both ends of third housing tubular 345 may be secured through the use of any suitable mechanisms, including, but not limited to, the use of suitable fasteners, threading, adhesives, welding, and/or combinations thereof. In examples, the ends of third housing tubular 345 may comprise either male or female threads. For example, the end adjacent second check valve 350 may include threads 346. In further examples, as the fluid is displaced into third housing tubular 345, piston 320 may further displace the fluid out of third housing tubular 345 and into second check valve 350. Second check valve 350 may allow the flow of fluid in one direction. Second check valve 350 may comprise of a valve housing 352, second check valve body 355, a third ball 360, and a third spring 365. Valve housing 352 may be secured to third housing tubular 345, for example, by threads 346 on an end of third housing tubular 345. However, other suitable fasteners may also be used. Second check valve body 355, third ball 360, and third spring 365 may be disposed in valve housing 352.

Second check valve body 355 may serve to exert a force onto third ball 360. Second check valve body 355 may be any suitable size, height, or shape. Without limitation, second check valve body 355 may comprise any suitable material such as metals, nonmetals, polymers, ceramics, and/or any combination thereof. In examples, an end of second check valve body 355 may mirror the shape of third ball 360. In examples, as the fluid is displaced into second check valve 350, the force of the fluid's movement may be transferred to second check valve body 355. Second check valve body 355 may subsequently push against third ball 360.

Third ball 360 may compress third spring 365. Third ball 360 may be any suitable size, height, or shape. In examples, third ball 360 may be a sphere. Without limitation, third ball 360 may comprise any suitable material such as metals, nonmetals, polymers, ceramics, and/or any combination thereof. In examples third ball 360 may have similar dimensions and function the same way as first ball 255 (e.g., referring to FIG. 2) and/or second ball 330. Alternatively, third ball 360 may have varying dimensions and may function differently from first ball 255 and/or second ball 330. In examples, as second check valve body 355 pushes against third ball 360, third ball 360 may exert a force onto third spring 365 that may compress third spring 365.

Third spring 365 may supply a resistance to a compressive force. Third spring 365 may be any suitable size, height, or shape. Without limitation, third spring 365 may comprise any suitable material such as metals, nonmetals, polymers, ceramics, and/or any combination thereof. An end of third spring 365 may be disposed about third ball 360. An opposing end of second spring 325 may be disposed within a nozzle 370 coupled to an end of second check valve 350. A tubular extension 375 may be coupled to fluid placement tool 100 at nozzle 370. The tubular extension 375 may allow for discharge of the fluid at a selected distance below the fluid placement tool 100. Any suitable technique may be used for coupling of the tubular extension 375 to nozzle 370, including, but not limited to, suitable fasteners, threading, adhesives, welding, and/or combinations thereof.

Referring again to FIG. 1, an example method of operation of fluid placement tool 100 for delivery of the fluid into wellbore 120 will now be described. In examples, an operator may dispose fluid placement tool 100 into a tubular (e.g., a core barrel) disposed in wellbore 120. In examples, the operator may dispose fluid placement tool 100 until fluid placement tool 100 is seated against the landing ring (e.g., an inner shoulder) of core barrel 140. A landing indicator may inform the operator that fluid placement tool 100 has landed correctly. In examples, the landing indicator may be any suitable pressure gauge. Landing correctly may seal off portions of fluid placement tool 100 within the core barrel 140. For example, portions of wellbore 120 below landing shoulder 270 (e.g., shown on FIG. 2) may be sealed off from a portion of wellbore 120 above landing shoulder 270. The operator may pressurize fluid placement tool 100 to a designated value. Pressuring the fluid placement tool 100 may include increasing the pressure of fluid placement tool 100 with any suitable fluids used in downhole operations, for example, by increasing pressure in core barrel 140.

With additional reference to FIGS. 2 and 3, pressurizing fluid placement tool 100 may push ball shaft 245 further axially into fluid placement tool 100, thus also displacing first ball 255. First ball 255 may be displaced axially through fluid placement tool 100 toward its distal end until first ball 255 makes contact with bushing within sleeve 265. As first ball 255 seats into the bushing, sleeve 265 may be actuated to displace further into second housing tubular 275. As sleeve 265 displaces through second housing tubular 275, holes 266 may not be aligned with holes 276, thereby maintaining pressure within fluid placement tool 100. Fluid pressure may now pass through ball stop 310 and into first check valve 315. Fluid pressure may push against second ball 330 to seat into first check valve body 335, thereby compressing second spring 325. The fluid pressure may then cause piston 320 to displace fluid contained within fluid reservoir 340 out of second check valve 350. After operation, there may be a pressure imbalance. Second check valve 350 may inhibit the re-entry of fluids into fluid placement tool 100. The internal pressure may be equalized with the external pressure relative to fluid placement tool 100 by utilizing holes 266 disposed on first housing tubular 260 and holes 276 disposed on second housing tubular 275. In examples, the operator may use any suitable fishing tool to attach to spearhead 215. As spearhead 215 is displaced uphole, first ball 255 may be subsequently displaced uphole. As first ball 255 displaces uphole, sleeve 265 may displace uphole through second housing tubular 275 and align holes 266 with 276, thereby equalizing the pressure. The operator may retrieve fluid placement tool 100 once the pressures have been equalized.

The preceding description provides various examples of systems and methods of use which may contain different method steps and alternative combinations of components. It should be understood that, although individual examples may be discussed herein, the present disclosure covers all combinations of the disclosed examples, including, without limitation, the different component combinations, method step combinations, and properties of the system.

Statement 1. A fluid placement tool, comprising: a connecting section at a proximal end of the fluid placement tool for coupling the fluid placement tool to a conveyance; an actuating section coupled to the connecting section, wherein the actuating section comprises a first check valve and a piston, wherein the first check valve is positioned to only allow fluid flow axially through the actuating section and into engagement with the piston; and a fluid containment section at a distal end of the fluid placement tool, wherein the fluid containment section comprises a fluid reservoir and a second check valve, wherein the fluid reservoir is disposed between the first check valve and the second check valve, wherein the second check valve is position to only allow flow out of the fluid containment section; wherein the actuating section is operable to drive the piston through the fluid reservoir for displacement of a fluid from the fluid reservoir and into a wellbore.

Statement 2. The fluid placement tool of statement 1, wherein the conveyance is a wireline.

Statement 3. The fluid placement tool of statement 1 or 2, wherein the connecting section comprises a spearhead, a first spring disposed in the spearhead, a base coupled the spearhead, and a plunger disposed in the spearhead between the first spring and the base, wherein the plunger is in engagement with the first spring.

Statement 4. The fluid placement tool of statement 3, wherein a first end of the spearhead engages the conveyance, and wherein a second end of the spearhead is coupled to the base.

Statement 5. The fluid placement tool of statement 3, wherein the plunger has a shape that mirrors that of an opening in the base, wherein the base couples the connecting section to the actuating section.

Statement 6. The fluid placement tool of any of the preceding statements, wherein the actuating section further comprises an upper housing, a first housing tubular coupled to the upper housing, an inner tubular coupled to the connection section and at least partially disposed through the upper housing and the first housing tubular, a ball shaft disposed in the inner tubular and axially displaceable therein, a retaining cap coupled to an end of the inner tubular, a first ball secured on the ball shaft, a sleeve disposed in the first housing tubular, a second housing tubular coupled to the first housing tubular, a landing shoulder secured on the second housing tubular and a ball stop.

Statement 7. The fluid placement tool of statement 6, wherein the upper housing receives a base of the connecting section.

Statement 8. The fluid placement tool of statement 7, wherein a pin is disposed through both a hole at a first end of the inner tubular and a hole in the base to secure the inner tubular to the base.

Statement 9. The fluid placement tool of statement 6, wherein the first ball is disposed at a distal end of the ball shaft, wherein the retaining cap is disposed around the distal end of the ball shaft.

Statement 10. The fluid placement tool of statement 6, wherein the sleeve abuts the landing shoulder, wherein the landing shoulder is disposed around an end of the second housing tubular.

Statement 11. The fluid placement tool of statement 6, wherein the ball stop is disposed within the second housing tubular, wherein the ball stop is actuated to axially displace into the first check valve.

Statement 12. The fluid placement tool of any of the preceding statements, wherein the first check valve comprises a first valve housing, second spring disposed in the first valve housing, a second ball in the first valve housing and in engagement with the second spring, and a first check valve body in first valve housing that receives the second ball.

Statement 13. The fluid placement tool of any of the preceding statements, wherein the fluid is a cement, resin, a fluid comprising lost circulation material, or combination thereof.

Statement 14. The fluid placement tool of any of the preceding statements, wherein the second check valve comprises a second valve housing, a second check valve body disposed in the second valve housing, a third ball disposed in the second valve housing and received in the second check valve body, and a third spring in engagement with the third ball.

Statement 15. The fluid placement tool of statement 14, further comprising a nozzle coupled to the distal end of the second valve housing, wherein a tubular extension is coupled to nozzle.

Statement 16. A fluid placement tool comprising: a connecting section at a proximal end of the fluid placement tool, wherein the connecting section comprises: a connecting mechanism for coupling the fluid placement tool to a conveyance, wherein the connecting mechanism has a hollow bore; a first spring disposed in the connecting mechanism; a base coupled the connecting mechanism; and a plunger disposed in the connecting mechanism between the first spring and the base, wherein the plunger is in engagement with the first spring; an actuating section coupled to the connecting section, wherein the actuating section comprises: an upper housing that receives the base; a first housing tubular coupled to the upper housing; an inner tubular and at least partially disposed through the upper housing and the first housing tubular, wherein a proximal end of the inner tubular is secured to a distal end of the base; a ball shaft disposed in the inner tubular and axially displaceable therein; a retaining cap coupled to an end of the inner tubular and disposed around the distal end of the ball shaft; a first ball secured to the ball shaft; a sleeve disposed in the first housing tubular; a second housing tubular coupled to the first housing tubular; a landing shoulder secured on a threaded end of the second housing tubular and configured to engage a corresponding surface on a tubular in which the fluid placement tool is disposed, wherein the sleeve abuts the landing shoulder; a ball stop disposed to engage the first ball when translating in the actuating section; a first check valve disposed on an opposite side of the ball stop from the first ball; and a piston disposed on an opposite side of the first check valve from the ball stop, wherein the first check valve is positioned to only allow fluid flow axially through the actuating section and into engagement with the piston; a fluid containment section at a distal end of the fluid placement tool, wherein the fluid containment section comprises: a fluid reservoir; and a second check valve, wherein the fluid reservoir is disposed between the first check valve and the second check valve, wherein the second check valve is position to only allow flow out of the fluid containment section; and a nozzle coupled to a distal end of the second check valve; and a tubular extension coupled to the nozzle that extends from downward away from the nozzle, wherein the actuating section is operable to drive the piston through the fluid reservoir for displacement of a fluid from the fluid reservoir and into a wellbore.

Statement 17. A method for disposing a fluid into a wellbore, comprising: conveying a fluid placement tool on a conveyance into a tubular disposed in the wellbore, wherein the fluid placement tool comprises: a connecting section at a proximal end of the fluid placement tool for coupling the fluid placement tool to a conveyance; an actuating section coupled to the connecting section, wherein the actuating section comprises a first check valve and a piston, wherein the first check valve is positioned to only allow fluid flow axially through the actuating section and into engagement with the piston; and a fluid containment section at a distal end of the fluid placement tool, wherein the fluid containment section comprises a fluid reservoir and a second check valve, wherein the fluid reservoir is disposed between the first check valve and the second check valve, wherein the second check valve is position to only allow flow out of the fluid containment section, wherein the fluid reservoir comprises a fluid; and pressurizing the fluid placement tool to open the first check valve and drive the piston through the fluid reservoir such that the fluid is at least partially displaced through the second check valve and out of the fluid placement tool.

Statement 18. The method of statement 17, wherein pressurizing the fluid placement tool comprises of actuating a ball shaft to displace a first ball axially through the actuating section and into a ball stop.

Statement 19. The method of statement 17 or 18, wherein the fluid placement tool is conveyed into the tubular until a landing collar of the fluid placement tool is seated on a corresponding surface in the tubular.

Statement 20. The method of any one of statements 17 to 19, further comprising, prior to retrieving the fluid placement tool from the wellbore, equalizing pressure on either side of the landing collar by opening one or more openings in the fluid placement tool to allow fluid communication in the wellbore such that differential pressure on either side of a landing collar on which the fluid placement tool is disposed in the tubular is equalized.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only, and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A fluid placement tool, comprising:

a connecting section at a proximal end of the fluid placement tool for coupling the fluid placement tool to a conveyance;

an actuating section coupled to the connecting section, wherein the actuating section comprises a first check valve and a piston, wherein the first check valve is positioned to only allow fluid flow axially through the actuating section and into engagement with the piston; and a fluid containment section at a distal end of the fluid placement tool, wherein the fluid containment section comprises a fluid reservoir and a second check valve, wherein the fluid reservoir is disposed between the first check valve and the second check valve, wherein the second check valve is position to only allow flow out of the fluid containment section;

wherein the actuating section is operable to drive the piston through the fluid reservoir for displacement of a fluid from the fluid reservoir and into a wellbore;

wherein the first check valve comprises a first valve housing, a first spring disposed in the first valve housing, a first ball disposed in the first valve housing and in engagement with the first spring, and a first check valve body in the first valve housing that receives the first ball; and wherein the second check valve comprises a second valve housing, a second check valve body disposed in the second valve housing, a second ball disposed in the second valve housing and received in the second check valve body, and a second spring in engagement with the second ball.

2. The fluid placement tool of claim 1, wherein the conveyance is a wireline.

3. The fluid placement tool of claim 1, wherein the fluid is a cement, resin, a fluid comprising lost circulation material, or combination thereof.

4. The fluid placement tool of claim 1, further comprising a nozzle coupled to the distal end of the second valve housing, wherein a tubular extension is coupled to nozzle.

5. A fluid placement tool, comprising:

a connecting section at a proximal end of the fluid placement tool for coupling the fluid placement tool to a conveyance;

an actuating section coupled to the connecting section, wherein the actuating section comprises a first check valve and a piston, wherein the first check valve is positioned to only allow fluid flow axially through the actuating section and into engagement with the piston; and a fluid containment section at a distal end of the fluid placement tool, wherein the fluid containment section comprises a fluid reservoir and a second check valve, wherein the fluid reservoir is disposed between the first check valve and the second check valve, wherein the second check valve is position to only allow flow out of the fluid containment section;

wherein the actuating section is operable to drive the piston through the fluid reservoir for displacement of a fluid from the fluid reservoir and into a wellbore;

wherein the connecting section comprises a spearhead, a first spring disposed in the spearhead, a base coupled to the spearhead, and a plunger disposed in the spearhead between the first spring and the base, wherein the plunger is in engagement with the first spring.

6. The fluid placement tool of claim 5, wherein a first end of the spearhead engages the conveyance, and wherein a second end of the spearhead is coupled to the base.

7. The fluid placement tool of claim 5, wherein the plunger has a shape that mirrors that of an opening in the base, wherein the base couples the connecting section to the actuating section.

8. A fluid placement tool, comprising:

a connecting section at a proximal end of the fluid placement tool for coupling the fluid placement tool to a conveyance;

an actuating section coupled to the connecting section, wherein the actuating section comprises a first check valve and a piston, wherein the first check valve is positioned to only allow fluid flow axially through the actuating section and into engagement with the piston; and a fluid containment section at a distal end of the fluid placement tool, wherein the fluid containment section comprises a fluid reservoir and a second check valve, wherein the fluid reservoir is disposed between the first check valve and the second check valve, wherein the second check valve is position to only allow flow out of the fluid containment section;

wherein the actuating section is operable to drive the piston through the fluid reservoir for displacement of a fluid from the fluid reservoir and into a wellbore;

wherein the actuating section further comprises an upper housing, a first housing tubular coupled to the upper housing, an inner tubular coupled to the connection section and at least partially disposed through the upper housing and the first housing tubular, a ball shaft disposed in the inner tubular and axially displaceable therein, a retaining cap coupled to an end of the inner tubular, a first ball secured on the ball shaft, a sleeve disposed in the first housing tubular, a second housing tubular coupled to the first housing tubular, a landing shoulder secured on the second housing tubular and a ball stop.

9. The fluid placement tool of claim 8, wherein the upper housing receives a base of the connecting section.

10. The fluid placement tool of claim 9, wherein a pin is disposed through both a hole at a first end of the inner tubular and a hole in the base to secure the inner tubular to the base.

11. The fluid placement tool of claim 8, wherein the first ball is disposed at a distal end of the ball shaft, wherein the retaining cap is disposed around the distal end of the ball shaft.

12. The fluid placement tool of claim 8, wherein the sleeve abuts the landing shoulder, wherein the landing shoulder is disposed around an end of the second housing tubular.

13. The fluid placement tool of claim 8, wherein the ball stop is disposed within the second housing tubular, wherein the ball stop is actuated to axially displace into the first check valve.

14. A fluid placement tool comprising:

a connecting section at a proximal end of the fluid placement tool, wherein the connecting section comprises:

a connecting mechanism for coupling the fluid placement tool to a conveyance, wherein the connecting mechanism has a hollow bore;

a first spring disposed in the connecting mechanism;

a base coupled the connecting mechanism; and a plunger disposed in the connecting mechanism between the first spring and the base, wherein the plunger is in engagement with the first spring;

an actuating section coupled to the connecting section, wherein the actuating section comprises:

an upper housing that receives the base;

a first housing tubular coupled to the upper housing;

an inner tubular and at least partially disposed through the upper housing and the first housing tubular, wherein a proximal end of the inner tubular is secured to a distal end of the base;

a ball shaft disposed in the inner tubular and axially displaceable therein;

a retaining cap coupled to an end of the inner tubular and disposed around the distal end of the ball shaft;

a first ball secured to the ball shaft;

a sleeve disposed in the first housing tubular;

a second housing tubular coupled to the first housing tubular;

a landing shoulder secured on a threaded end of the second housing tubular and configured to engage a corresponding surface on a tubular in which the fluid placement tool is disposed, wherein the sleeve abuts the landing shoulder;

a ball stop disposed to engage the first ball when translating in the actuating section;

a first check valve disposed on an opposite side of the ball stop from the first ball; and a piston disposed on an opposite side of the first check valve from the ball stop, wherein the first check valve is positioned to only allow fluid flow axially through the actuating section and into engagement with the piston;

a fluid containment section at a distal end of the fluid placement tool, wherein the fluid containment section comprises:

a fluid reservoir; and a second check valve, wherein the fluid reservoir is disposed between the first check valve and the second check valve, wherein the second check valve is position to only allow flow out of the fluid containment section; and a nozzle coupled to a distal end of the second check valve; and a tubular extension coupled to the nozzle that extends from downward away from the nozzle, wherein the actuating section is operable to drive the piston through the fluid reservoir for displacement of a fluid from the fluid reservoir and into a wellbore.

15. A method for disposing a fluid into a wellbore, comprising:

conveying a fluid placement tool on a conveyance into a tubular disposed in the wellbore, wherein the fluid placement tool comprises:

a connecting section at a proximal end of the fluid placement tool for coupling the fluid placement tool to a conveyance;

an actuating section coupled to the connecting section, wherein the actuating section comprises a first check valve and a piston, wherein the first check valve is positioned to only allow fluid flow axially through the actuating section and into engagement with the piston; and a fluid containment section at a distal end of the fluid placement tool, wherein the fluid containment section comprises a fluid reservoir and a second check valve, wherein the fluid reservoir is disposed between the first check valve and the second check valve, wherein the second check valve is position to only allow flow out of the fluid containment section, wherein the fluid reservoir comprises a fluid; and pressurizing the fluid placement tool to open the first check valve and drive the piston through the fluid reservoir such that the fluid is at least partially displaced through the second check valve and out of the fluid placement tool, wherein pressurizing the fluid placement tool comprises of actuating a ball shaft to displace a first ball axially through the actuating section and into a ball stop.

16. The method of claim 15, wherein the fluid placement tool is conveyed into the tubular until a landing collar of the fluid placement tool is seated on a corresponding surface in the tubular.

17. The method of claim 15, further comprising, prior to retrieving the fluid placement tool from the wellbore, equalizing pressure on either side of the landing collar by opening one or more openings in the fluid placement tool to allow fluid communication in the wellbore such that differential pressure on either side of a landing collar on which the fluid placement tool is disposed in the tubular is equalized.

* * * * *